US011487247B2

(12) United States Patent
Takasawa et al.

(10) Patent No.: US 11,487,247 B2
(45) Date of Patent: Nov. 1, 2022

(54) TIMEPIECE CASE AND TIMEPIECE

(71) Applicant: SEIKO EPSON CORPORATION, Tokyo (JP)

(72) Inventors: Koki Takasawa, Suwa (JP); Kiyoto Takeda, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 542 days.

(21) Appl. No.: 16/654,158

(22) Filed: Oct. 16, 2019

(65) Prior Publication Data

US 2020/0125034 A1 Apr. 23, 2020

(30) Foreign Application Priority Data

Oct. 17, 2018 (JP) ..... JP2018-195556
Mar. 25, 2019 (JP) ..... JP2019-056897

(51) Int. Cl.
*G04B 37/10* (2006.01)
*G04B 37/04* (2006.01)

(52) U.S. Cl.
CPC ..... *G04B 37/106* (2013.01); *G04B 37/04* (2013.01)

(58) Field of Classification Search
CPC ..... G04B 3/048; G04B 37/04; G04B 37/106; G04B 3/041; G04B 3/043; G04B 3/045; G04B 17/06; G04C 3/001; G04C 3/007; H01H 67/06; H01H 61/12
See application file for complete search history.

(56) References Cited

U.S. PATENT DOCUMENTS 3,621,649 A * 11/1971 Vulcan et al. ..... G04B 37/10 968/339
6,000,842 A * 12/1999 Muller ..... G04B 37/106 368/321
8,920,022 B2 * 12/2014 Ishida ..... G04B 37/106 368/320
9,952,560 B2 4/2018 Suzuki
10,019,097 B2 * 7/2018 Ely ..... G06F 3/0362
2003/0174590 A1 * 9/2003 Arikawa ..... G04B 37/106 368/319

FOREIGN PATENT DOCUMENTS

CN 104769509 A * 7/2015 ..... G04B 17/10
JP 2017-078654 A 4/2017

* cited by examiner

*Primary Examiner* — Edwin A. Leon
(74) *Attorney, Agent, or Firm* — Oliff PLC

(57) ABSTRACT

Provided is a timepiece case that does not require a seal ring, such as an O ring, that is made of a resin material. The timepiece case includes a case body configured from metallic glass; and a button part that is formed integrally with the case body and is flexible.

19 Claims, 9 Drawing Sheets

TIMEPIECE CASE AND TIMEPIECE

BACKGROUND

1. Technical Field

The present invention relates to a timepiece case and to a timepiece.

The present application claims priority based on and incorporates by reference the entire contents of Japanese Patent Application No. 2018-195556 filed in Japan on Oct. 17, 2018, and Japanese Patent Application No. 2019-056897 filed on Mar. 25, 2019.

2. Related Art

JP-A-2017-78654 describes a switching device having a through-hole in the side of a timepiece case, a tubular member inside the through-hole, and the shaft part of a button passing through the tubular member. To assure the water resistance of the timepiece case, this switching device has multiple seal rings around the outside of the shaft part of the button, providing a watertight seal between the tubular part and the shaft part.

The seal rings of the water-resistant structure described in JP-A-2017-78654 are O rings or other rubber (plastic) members, and therefore degrade over time. As a result, the seal rings must be periodically replaced to maintain water resistance due to deterioration of the seal rings over time.

SUMMARY

A timepiece case according to a preferred aspect of the invention includes a case body configured from metallic glass; and a button part that is formed integrally with the case body and is flexible.

In a timepiece case according to another aspect of the invention, the metallic glass has an elastic modulus greater than or equal to 30 GPa and less than or equal to 140 GPa, and an elastic limit greater than or equal to 2% and less than or equal to 20%.

In a timepiece case according to another aspect of the invention, a recess is formed receding from the inside circumference surface of the case body; and a button shaft part that moves in conjunction with operation of the button part is disposed in the recess.

A timepiece case according to another aspect of the invention preferably also has a guide pipe disposed to the inside circumference side of the recess and guiding the button shaft part; and a return spring disposed between the guide pipe and the button shaft part, and urging the button shaft part to the button part side relative to the guide pipe.

In a timepiece case according to another aspect of the invention, a recess is formed receding from the inside circumference surface of the case body; and the button part is formed in unison with the button shaft part disposed in the recess.

In a timepiece case according to another aspect of the invention, a guide member that guides the button shaft part is disposed in the case body.

In a timepiece case according to another aspect of the invention, the button part is formed in a recessed shape from the outside circumference side of the case body.

Another aspect of the invention is a timepiece including a timepiece case having a case body configured from metallic glass, and a button part that is formed integrally with the case body and is flexible; and a movement which is held in the timepiece case, and of which an operating function is selected by operation of the button part.

In a timepiece according to another aspect of the invention, a recess is formed receding from the inside circumference surface of the case body; a button shaft part that moves in conjunction with operation of the button part is disposed in the recess; and the button shaft part is disposed to the timepiece case or the movement.

A timepiece according to another aspect of the invention preferably also has a case ring holding the movement in the case body and disposed between the case body and the movement; a communicating hole formed in the case ring between the case body side and the movement side, and a button shaft part that moves in conjunction with operation of the button part disposed in the communicating hole.

In a timepiece according to another aspect of the invention, the button part is formed in a recessed shape from the outside circumference side of the case body.

A timepiece according to another aspect of the invention includes a timepiece case including a case body configured from metallic glass, and a diaphragm formed integrally to the case body and deformed in response to applied pressure; and a detector configured to detect pressure acting on the diaphragm.

Other objects and attainments together with a fuller understanding of the invention will become apparent and appreciated by referring to the following description and claims taken in conjunction with the accompanying drawings.

DESCRIPTION OF EMBODIMENTS

Embodiment 1

Figure 1:
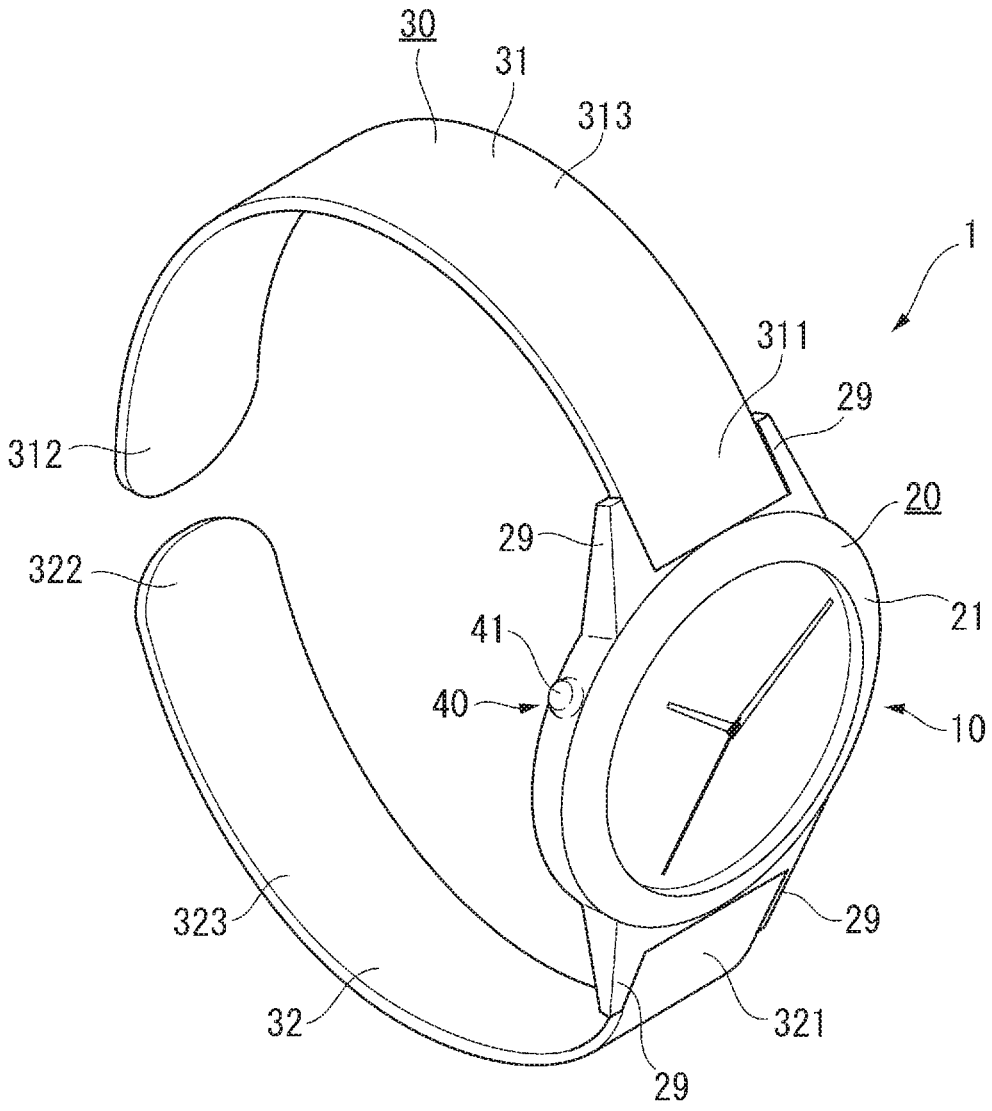
FIG. 1 is an perspective view of a timepiece according to a first embodiment of the invention.

A timepiece 1 according to a first embodiment of the invention is described below with reference to FIG. 1 and FIG. 2. The timepiece 1 includes an exterior watch part 10, and the exterior watch part 10 includes a case member 20 and a watch band 30.

The case member 20 is a case that holds a movement 25. The movement 25 contained in the case member 20 may be a quartz movement including a crystal oscillator, battery, motor, wheel train, and hands, or a mechanical movement including a main spring, escape wheel, escape lever, wheel train, and hands. The case member 20 may also hold a digital display device without hands.

The case member 20 in this example has a substantially round case body 21 configured from metallic glass having an elastic modulus greater than or equal to 30 GPa and less than or equal to 140 GPa, and an elastic limit greater than or equal to 2% and less than or equal to 20%.

The watch band 30 is configured separately from the case member 20, and includes a first band 31 attached to the 12:00 side of the case member 20, and a second band 32 attached to the 6:00 side of the case member 20.

The exterior watch part 10 therefore includes the case body 21, and a first band 31 and second band 32 configured separately from the case body 21.

A metallic glass based on Pt, Au, Ti, Mg, Pd, or Zr may be used as the metallic glass configuring the case member 20. More specifically, a metallic glass composed of Zr55Al10Ni5Cu30, Mg65Cu25Al10, Pt6OCu18P22, Au65Cu15.5Ag7.5Si17, or Ti43Zr2Hf5Cu42Ni7Si1 (at. %) can be used.

As described above, the metallic glass used to configure the case member 20 preferably has an elastic modulus greater than or equal to 30 GPa and less than or equal to 140 GPa, and an elastic limit greater than or equal to 2% and less than or equal to 20%. Further preferably, the hardness of the metallic glass is within a range greater than or equal to 300 Hv and less than or equal to 500 Hv. The thickness of the case member 20 is set appropriately to the required strength and other properties of the case member 20. More specifically, the thickness of the case member 20 is set to assure strength sufficient to hold the movement 25.

When the elastic modulus of the metallic glass case member 20 is less than 30 GPa, the case member 20 is easily elastically deformed, the thickness of the case member 20 must therefore be increased, and the weight increases. If the elastic modulus is greater than 140 GPa, the flexibility of the button part 41 described below decreases and operating (deforming) the button part 41 becomes more difficult. As a result, the elastic modulus of the metallic glass forming the case member 20 is preferably greater than or equal to 30 GPa and less than or equal to 140 GPa.

If the elastic limit of the metallic glass forming the case member 20 is less than 2%, the case member 20 is more easily damaged by force applied to the case member 20 during use, similarly to when the case member 20 is made from a crystalline metal. In addition, when great force is applied and the case member 20 is deformed, plastic deformation results and the case member 20 may not return to its original shape.

If the elastic limit exceeds 20%, the elastic region increases, and plastic working, including forging and processing, becomes more difficult. For example, even if compression is applied in the same way as with common crystalline metals, the case member 20 may return to its original shape due to spring back, the processing load increases, and dimensional precision cannot be assured by plastic working.

However, if the elastic limit is greater than or equal to 2% and less than or equal to 20%, the case member 20 is more resistant to damage and deformation during use, and increasing the load during molding and decreasing dimensional precision can be prevented.

If the hardness of the case member 20 is less than 300 Hv, the case member 20 is easily scratched during use. If the hardness is greater than 500 Hv, processing the case member 20 is more difficult, and decoration is more difficult. As a result, decorative elements that can be added to the case member 20 are limited.

However, if the hardness is greater than or equal to 300 Hv and less than or equal to 500 Hv, the case member 20 is more resistant to scratching, the appearance can be improved, and limitations on decorative elements can be reduced.

A case member 20 of metallic glass can be formed in a molding process using a mold. Molding processes using a mold may include injection molding, casting, and processing using supercooled liquids. Examples of processing methods using a supercooled liquid include casting, pultrusion, extrusion, and pressing.

Because metallic glass has high transferability, surface decoration can be simultaneously imparted when molding the case member 20 by forming the decorative pattern to be formed on the surface of the case member in the mold.

A case member 20 made from metallic glass can also be manufactured by a 3D printer.

Figure 2:
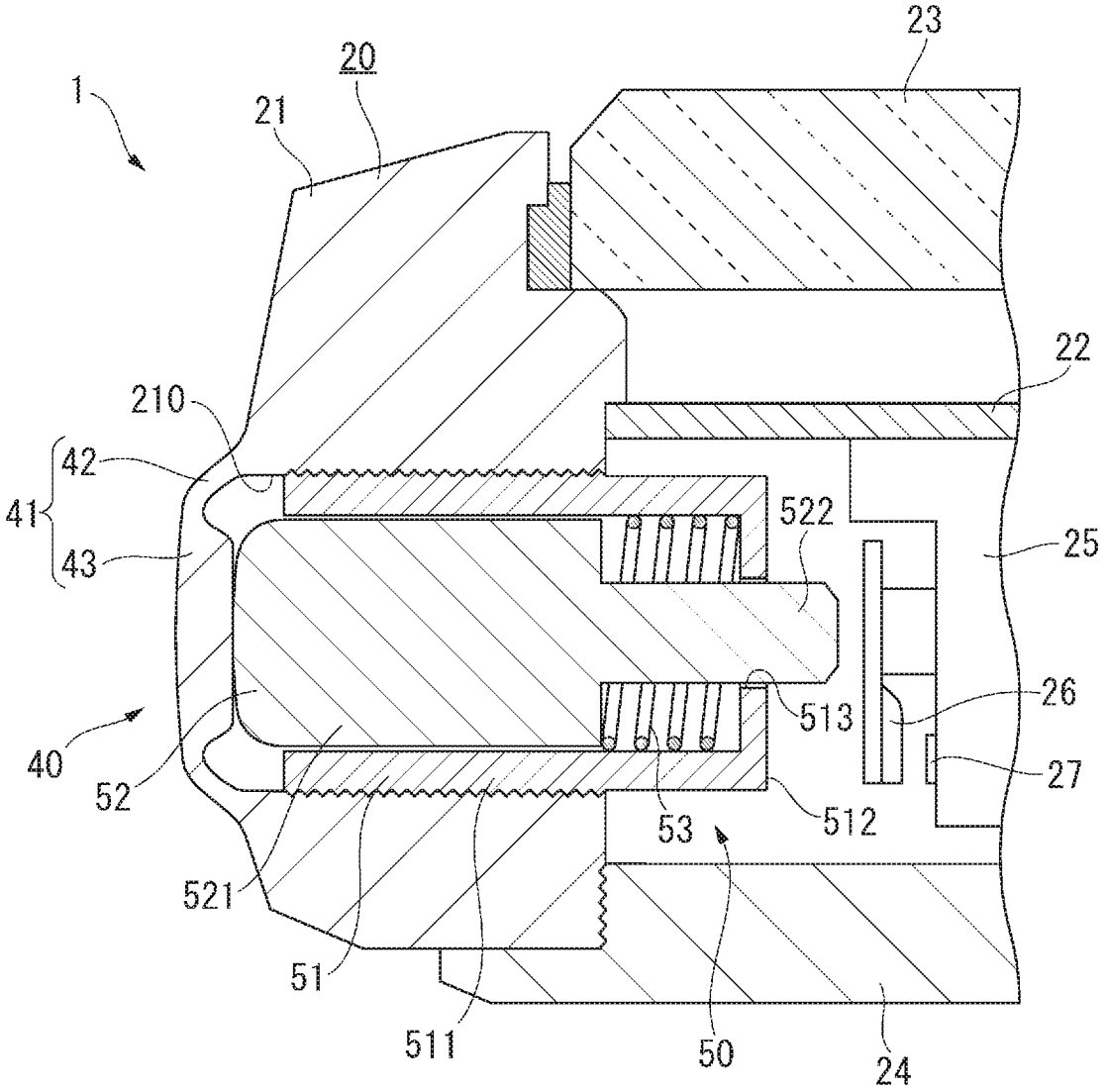
FIG. 2 is a section view illustrating main parts of the timepiece case in the first embodiment of the invention.

As shown in FIG. 2, a dial 22, and a movement 25, are disposed inside the case body 21 of the case member 20. A crystal 23 is attached to the opening on the face side of the case body 21, and a back cover 24 is attached to the opening on the opposite side of the case body 21.

The movement 25 includes a switch spring 26 that is operated by an operating button 40 described below, and a detection electrode 27 that detects button input by contact with the switch spring 26.

When assembling the timepiece 1, the crystal 23 is attached to the case body 21, the dial 22 and movement 25 are inserted to the case body 21 through the opening on the back cover side, and the back cover 24 is then installed to complete the timepiece 1.

As shown in FIG. 1, the watch band 30 has a first band 31 and second band 32. The first band 31 and second band 32 are configured as individual parts made of metallic glass. The metallic glass used for the first band 31 and second band 32 may be the same as the metallic glass forming the case member 20. However, because the first band 31 and second band 32 preferably deform flexibly to conform to the wrist of the user when the timepiece 1 is put on, the upper limit of the elastic modulus is lower than the metallic glass used for the case member 20. As a result, the elastic modulus of the metallic glass used for the first band 31 and second band 32 is preferably greater than or equal to 30 GPa and less than or equal to 70 GPa. Other characteristics of the metallic glass used for the first band 31 and second band 32, such as the elastic limit and hardness, are the same as the metallic glass of the case member 20.

The first band 31 and second band 32 curve along the length of the bands 31 and 32. More specifically, the first band 31 and second band 32 respectively have a base end part 311, 312 that attaches to the case member 20; a distal end part 312, 322, which is the end at the opposite end as the base end part 311, 312; and a middle part 313, 323 between the base end part 311, 312 and the distal end part 312, 322. The middle part 313, 323 curves from the base end part 311, 321 to the distal end part 312, 322.

As shown in FIG. 1, the case member 20, the first band 31, and the second band 32 have a C-shaped configuration when seen from the side of the timepiece 1.

As a result, the length of the first band 31 and second band 32 is set so that the first band 31 and second band 32 flex and spread, and a gap is formed between the base end parts 311, 312 when the watch band 30 is attached to the wrist of a user with slender wrists, such as women and children. As a result, when the watch band 30 is put on the wrist of a user with large wrists, the first band 31 and second band 32 expand further and the gap between the base end parts 311, 312 increases. When worn, the first band 31 and second band 32 therefore deform elastically according to the shape of the wrist of the user, the elastic force urging the first band 31 and second band 32 to return to the original shape holds the first band 31 and second band 32 tightly to the wrist, and the timepiece 1 can be held firmly on the wrist of the user.

While not shown in the figures, through-holes through which spring pins pass are formed in the base end parts 311, 312 of the first band 31 and second band 32. As a result, the first band 31 and second band 32 can be attached by spring pins to the lugs 29 of the case member 20, and can be attached using the same configuration used with metal link bands, leather bands, and plastic bands.

The construction of the operating button 40 disposed in the case member 20 is described next with reference to FIG. 1 and FIG. 2.

As shown in FIG. 1, the operating button 40 is disposed to the case member 20 at approximately the 10:00 position on the dial 22. However, the operating button 40 may be disposed to the case member 20 at approximately the 2:00, 4:00, 8:00, or other position, and multiple operating buttons 40 may be provided.

As shown in FIG. 2, the operating button 40 includes a button part 41 formed in unison with the case body 21, and a button unit 50 disposed inside the case body 21.

The button part 41 is configured by flexible structure formed in unison with the case body 21 of the case member 20. More specifically, the button part 41 is formed in unison with the case body 21 made of a metallic glass, and is formed as a thin-wall member with a thickness that is less than the case body 21 so that the button part 41 is flexible.

As shown in FIG. 1 and FIG. 2, the button part 41 has the shape of a circular truncated cone protruding from the side of the case body 21. More specifically, the button part 41 has a side part 42 contiguous to the case body 21, and a substantially disk-shaped top part 43 contiguous to the side part 42.

As a result, when the user of the timepiece 1 pushes against the top part 43, the side part 42 elastically deforms, and the top part 43 moves toward the inside of the case body 21. Note that by making the thickness of the top part 43 thicker than the side part 42, the rigidity of the button part 41 increases and a clear click or operating sensation can be achieved.

Inside the case body 21 is formed a recess 210 that recedes from the inside circumference surface of the case body 21.

The button unit 50, which moves in conjunction with the button part 41, is disposed inside the recess 210. The button unit 50 includes a guide pipe 51, button shaft member 52, and return spring 53.

The guide pipe 51 has a substantially cylindrical side part 511, and a bottom part 512 formed contiguously to one end of the side part 511. A through-hole 513 is formed in the center of the bottom part 512 of the guide pipe 51.

The guide pipe 51 may be press fit and secured inside the recess 210, and affixed by adhesive, for example, to the inside wall of the recess 210. However, in this embodiment of the invention a male thread is formed on the side part 511 of the guide pipe 51, and the guide pipe 51 is attached to the recess 210 by screwing this male thread member to a female thread formed in the inside wall of the recess 210.

The button shaft member 52 includes a guide part 521 that is guided by the side part 511 of the guide pipe 51, and a button shaft 522 that has a smaller diameter than the guide part 521, is inserted to the through-hole 513, and is disposed movably in the axial direction inside the guide pipe 51.

Note that the button shaft member 52 is an example of a button shaft part in the accompanying claims of the invention.

The return spring 53 is configured in the guide pipe 51 by a coil spring disposed between the bottom part 512 of the guide pipe 51, and the guide part 521 of the button shaft member 52. The return spring 53 urges the button shaft member 52 inside the guide pipe 51 in the direction toward the top part 43 of the button part 41. As a result, the button shaft member 52 is disposed in contact with the top part 43 of the button part 41.

The button shaft 522 of the button shaft member 52 is disposed in opposition to the switch spring 26 in the movement 25. When the button part 41 is not pushed, the button shaft member 52 is urged by the return spring 53 to the button part 41 side, and there is a gap of a specific size between the button shaft 522 and the switch spring 26. The size of this gap is set smaller than the distance the button shaft member 52 can travel when the button part 41 is pushed.

When the user of the timepiece 1 pushes the button part 41 of the case member 20, force greater than the urging force of the return spring 53 is applied to the button shaft member 52 in contact with the top part 43, and the button shaft member 52 moves toward the switch spring 26.

When the button shaft member 52 travels a distance equal to or greater than this gap, the button shaft 522 contacts the switch spring 26. As a result, the switch spring 26 moves to the inside side of the movement 25, contacts the detection electrode 27 disposed to the movement 25, and the control device of the timepiece 1 can detect that the button part 41 was pushed. In other words, the movement 25 is configured so that operating functions can be selected by operating the button part 41.

More specifically, the movement 25 is configured so that operating functions such as adjusting the time and counting time can be selected according to when, how long, or the number of times operation of the button part 41 is detected.

When depression of the button part 41 by the user of the timepiece 1 is released, the button shaft member 52 moves in the direction away from the switch spring 26 due to the urging force of the return spring 53. As a result, the switch spring 26 separates from the detection electrode 27, and the control device of the timepiece 1 detects that operation (depression) of the button part 41 was released.

The return spring 53 then moves the top part 43 of the button part 41 toward the outside of the case member 20 through the intervening button shaft member 52, and the button part 41 returns to the original position protruding toward the outside of the case member 20.

Effect of Embodiment 1

A flexible button part 41 is formed integrally to the case body 21 of the case member 20. Because a button unit 50 is disposed in a recess 210 formed as a recess from the inside circumference side of the case body 21, water is prevented from entering from the button part 41 through the recess 210. As a result, unlike with the technology of the related art, there is no need to provide O rings or other seal rings, there is no need to replace such seal rings due to deterioration over time, and water resistance can be assured.

Furthermore, because the case member 20 is configured by a case body 21 and button part 41 formed in unison with the by metallic glass, the uniformity of the appearance of the case member 20 can be improved, and the aesthetic design of the timepiece 1 can be improved.

In addition, because the timepiece 1 is configured by a case member 20 and a watch band 30 made of metallic glass, the uniformity of the appearance of the case member 20 can be improved, and the aesthetic design of the timepiece 1 can be improved.

The button part 41 is formed from metallic glass in unison with the case body 21, and because metallic glass has high strength, the thickness of the side part 42 can be reduced and the flexibility of the button part 41 can be easily assured. In addition, because the metallic glass has a low elastic modulus of greater than or equal to 30 GPa and less than or equal to 140 GPa, when the top part 43 is pushed, the side part 42 smoothly deforms elastically, the travel and return of the top part 43 increase, and a flexible button part 41 can be easily configured.

Because the operating button 40 is configured by a button part 41 and a button unit 50 having a button shaft member 52, the operating button 40 is also compatible with case members 20 of different sizes. More specifically, when the same type of movement 25 is used in case members 20 of different sizes for men and for women, for example, the length from the button part 41 to the switch spring 26 differs. In such instances the same movement 25 can be used by simply replacing the button unit 50. More particularly, if multiple different button shafts 52 with shaft parts 522 of different lengths are prepared, common guide pipes 51 and return springs 53 can be used, and case members 20 of different sizes can be accommodated at a low cost.

Furthermore, because the button unit 50 is disposed between the button part 41 and switch spring 26, the thickness of the top part 43 of the button part 41 can be decreased appropriately to the side part 42. As a result, forming the button part 41 is simplified and the case body 21 can be easily manufactured.

The button unit 50 has a return spring 53 that urges the button shaft member 52 to the button part 41 side, and is set so that in the initial state when the button part 41 is not pressed, a gap of a specific size is assured between the button shaft 522 and the switch spring 26. As a result, when the button unit 50 is assembled in the recess 210, and the movement 25 is then inserted to the case body 21, interference between the button unit 50 and the switch spring 26 can be prevented. Therefore, the movement 25 can be easily disposed inside the case body 21, and the manufacturability of the timepiece 1 can be improved.

Because the first band 31 and second band 32 of the watch band 30 are both discrete parts made of metallic glass, the fit can be improved compared with a band comprising multiple metal links. More specifically, because a band having multiple links only bends at the connections between the links, a gap easily results between the wrist and the links of the timepiece band, and the fit of the band to the wrist when worn is limited.

However, because the first band 31 and second band 32 of the invention are made from metallic glass with a low elastic modulus of greater than or equal to 30 GPa and less than or equal to 70 GPa in this embodiment of the invention, the first band 31 and second band 32 deform smoothly according to the shape of the wrist when the timepiece 1 is put on the wrist, and the fit and feel can be improved.

In addition, because a band of metal links requires connecting the links together, improving productivity is difficult. However, because the first band 31 and second band 32 in the invention are single pieces, productivity can be easily improved compared with a band assembled from multiple metal links.

Furthermore, because the first band 31 and second band 32 are made from metallic glass, durability and water resistance can be improved compared with leather bands and plastic bands, and a metallic feel can be achieved.

Yet further, because the hardness of metallic glass is greater than crystalline metal, metallic glass is also more resistant to scratching. As a result, scratches can be prevented from degrading the appearance of the case member 20 and watch band 30. For example, while the hardness of a Pt alloy is greater than or equal to 50 Hv and less than or equal to 100 Hv, the hardness of metallic glass based on Pt is greater than or equal to 400 Hv and less than or equal to 500 Hv. As a result, the hardness of a case member 20 or watch band 30 made of metallic glass can be set greater than or equal to 300 Hv and less than or equal to 500 Hv, the elastic limit can be set to greater than or equal to 2%, and a case member 20 and watch band 30 with good scratch resistance, improved resistance to damage and plastic deformation during use, and high hardness resistant to damage can be provided.

Because the case member 20 and watch band 30 can be manufactured from metallic glass in a molding process, a timepiece case and band with excellent decorative decoration can be made. More specifically, because metallic glass has excellent transferability, by forming a decorative pattern in the mold, surface decoration can be formed simultaneously to molding the case member 20 and watch band 30, and productivity and decorativeness can be improved. For example, the case member 20 can be formed with an integral scale of numbers, letters, or other markings indicating time differences or time zones pointed to by hands. The watch band 30 can also be integrally formed with a decorative pattern or holes.

Because metallic glass has a lower melting point than crystalline metal and can be easily manufactured by casting, the productivity of the case member 20 and watch band 30 can also be improved.

Furthermore, because metallic glass has high hardness, the thickness of the case member 20 and watch band 30 can be reduced, and a lightweight case member 20 and watch band 30 can be produced.

Yet further, because metallic glass has low thermal conductivity, the case member 20 and watch band 30 do not feel cold when worn on the wrist. As a result, stimulating the sense of cold of the user of the timepiece 1, and feelings of discomfort, can be prevented.

Furthermore, because metallic glass has a large elastic deformation range, it has a smooth feel and is scratch resistant. As a result, scratching of the case member 20 and watch band 30 when the timepiece 1 is dropped, for example, can be prevented.

Furthermore, because the solidification shrinkage of metallic glass is low, change of shape during casting is small, and high precision casting is possible.

Furthermore, because metallic glass can be formed in a supercooled liquid state between a low viscosity solid and a liquid, viscoelastic processing is possible. More specifically, because metallic glass can be heated to a supercooled liquid state, high deformation rate processing is possible by heating, and high precision transferability on the nano order can be achieved. As a result, detailed decoration can be imparted to the surface of the case member 20 and watch band 30, a high precision finish can be imparted to the case member 20 and watch band 30 during the molding process, finishing work can be reduced, and productivity can be greatly improved.

Furthermore, because metallic glass does not have a grain boundary, abradability can be improved for surface polishing, and undulations caused by a grain boundary can be eliminated.

By manufacturing the case member 20 and watch band 30 from a metallic glass having the properties described above, a case member 20 and watch band 30 with various outstanding characteristics can be provided.

Embodiment 2

A timepiece 2 according to a second embodiment of the invention is described next with reference to FIG. 3. Note that like configurations in the timepiece 2 according to the second embodiment of the invention and the timepiece 1 according to the first embodiment of the invention are identified by like reference numerals, and further description thereof is omitted.

A timepiece 2 according to the second embodiment of the invention has a case member 20B and a timepiece band not shown that attaches to the case member 20B. The timepiece band may be the same as the watch band 30 of the first embodiment, and further description thereof is omitted.

The case member 20B has a ring-shaped case body 21B. Like the case body 21 of the first embodiment, the case body 21B is made from metallic glass with an elastic modulus greater than or equal to 30 GPa and less than or equal to 140 GPa, and an elastic limit greater than or equal to 2% and less than or equal to 20%.

The structure of the operating button 60 disposed to the case member 20B is described next. The operating button 60 has a button part 61 formed in unison with the case body 21B, and a button shaft part 65 integrally formed with the button part 61.

The button part 61 is a flexible configuration formed integrally with the case body 21B. More specifically, the button part 61 is formed in unison with the case body 21B made of metallic glass, and is formed as a thin-wall member with a thickness that is less than the case body 21B so that the button part 61 is flexible.

Similarly to the button part 41 in the first embodiment, the button part 61 has the shape of a circular truncated cone protruding from the side of the case body 21B, and more specifically includes a side part 62 contiguous to the case body 21B, and a substantially disk-shaped top part 63 contiguous to the side part 62.

As a result, when the user of the timepiece 1 pushes against the top part 63, the side part 62 elastically deforms, and the top part 63 moves toward the inside of the case body 21B. Note that because the thickness of the top part 63 thicker than the side part 62, the rigidity of the button part 61 increases and a clear click or operating sensation can be achieved.

Inside the case body 21B is formed a recess 210B that recedes from the inside circumference surface of the case body 21B similarly to the recess 210 in the first embodiment.

A button shaft part 65 formed in unison with the button part 61 is disposed inside the recess 210B. The button shaft part 65 is formed contiguously to the top part 63 of the button part 61, and extends from the top part 63 to the inside of the case body 21B, that is, toward the movement 25. As a result, the button shaft part 65 is disposed in contact with the switch spring 26B disposed in the movement 25.

The switch spring 26B is urged in the direction contacting the button shaft part 65 by a coil spring 28 disposed between the switch spring 26B and plastic parts such as the main plate and wheel train holder of the movement 25. As a result, the switch spring 26B is normally in contact with the button shaft part 65.

Note that the configuration urging the switch spring 26B to the button shaft part 65 side is not limited to a coil spring 28 separate from the switch spring 26B, and may use the spring force of the switch spring 26B itself.

When the user of the timepiece 2 pushes the button part 61 of the case member 20B, the top part 63 and button shaft part 65 move to the inside of the case body 21B. As a result, the switch spring 26B in contact with the button shaft part 65 also moves to the movement 25 side, contacts the detection electrode 27 disposed to the movement 25, and the control device disposed to the timepiece 2 can detect that the button part 61 was pressed.

When user of the timepiece 2 then releases the button part 61, the switch spring 26B and button shaft part 65 are urged by the coil spring 28 to move toward the outside side of the case member 20B. As a result, the switch spring 26B separates from the detection electrode 27, and the control device of the timepiece 2 can detect that the pressure on the button part 61 was released.

When the button shaft part 65 moves toward the outside of the case member 20B, the top part 63 of the button part 61 formed integrally with the button shaft part 65 also moves toward the outside of the case member 20B, and the button part 61 returns to the original state protruding toward the outside of the case member 20B.

Effect of Embodiment 2

A flexible button part 61 is formed in unison with the case body 21B of the case member 20B. Because the button shaft part 65 is disposed in a recess 210B formed as a recess in the inside circumference side of the case body 21B, the same effects as the first embodiment, including preventing penetration of water from the button part 61 through the recess 210B, can be achieved.

Note that because the button shaft part 65 is formed integrally with the button part 61 instead of using the button unit 50 of the first embodiment, the parts count can be reduced and the cost can be reduced.

Variation of Embodiment 2

Figure 4:
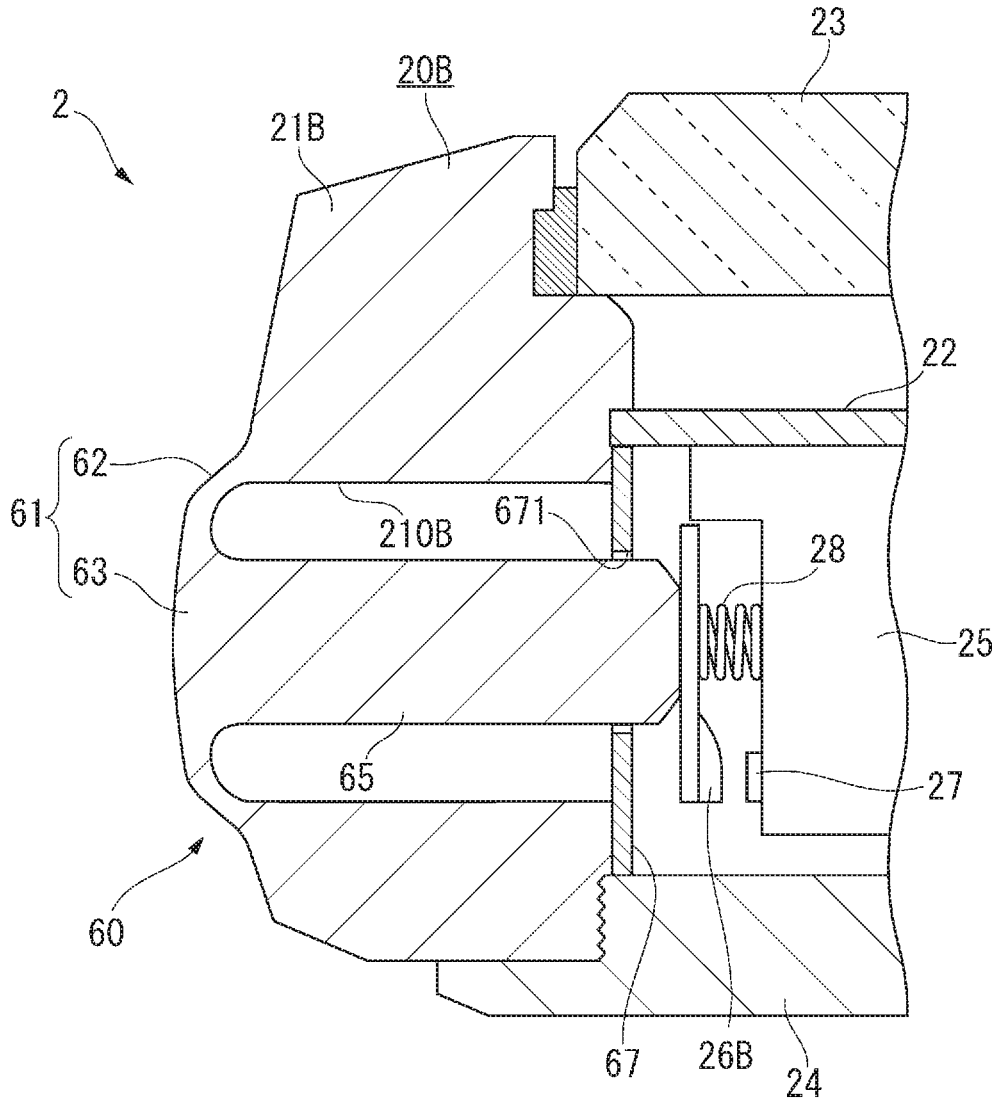
FIG. 4 is a section view illustrating main parts of the timepiece case in a variation of the second embodiment of the invention.

As shown in FIG. 4, the timepiece 2 of the second embodiment may also have a guide member 67 that guides the button shaft part 65 formed in unison with the button part 61. The guide member 67 in this variation is a flat plate and is disposed in contact with the inside circumference surface of the case body 21B. The guide member 67 also has a guide hole 671 in which the distal end part of the button shaft part 65 is inserted.

By providing this guide member 67, the distal end part of the button shaft part 65 can be guided by the guide hole 671 of the guide member 67, the distal end part of the button shaft part 65 can be prevented from swinging freely, and stable contact with the switch spring 26B can be maintained.

In addition, the coil spring 28 is disposed between the movement 25 and the switch spring 26B in the configuration shown in FIG. 4, but may be disposed between the guide member 67 and the side part 62, that is, the coil spring 28 may be disposed inside the recess 210B.

Embodiment 3

A timepiece 3 according to a third embodiment of the invention is described next with reference to FIG. 5. Note that like configurations in the timepiece 3 according to the third embodiment of the invention and the timepiece 1 according to the first embodiment of the invention are identified by like reference numerals, and further description thereof is omitted.

A timepiece 3 according to the third embodiment of the invention has a case member 20C and a timepiece band not shown that attaches to the case member 20C. The timepiece band may be the same as the watch band 30 of the first embodiment, and further description thereof is omitted.

The case member 20C has a ring-shaped case body 21C. Like the case body 21 of the first embodiment, the case body 21C is made from metallic glass with an elastic modulus greater than or equal to 30 GPa and less than or equal to 140 GPa, and an elastic limit greater than or equal to 2% and less than or equal to 20%.

Figure 5:
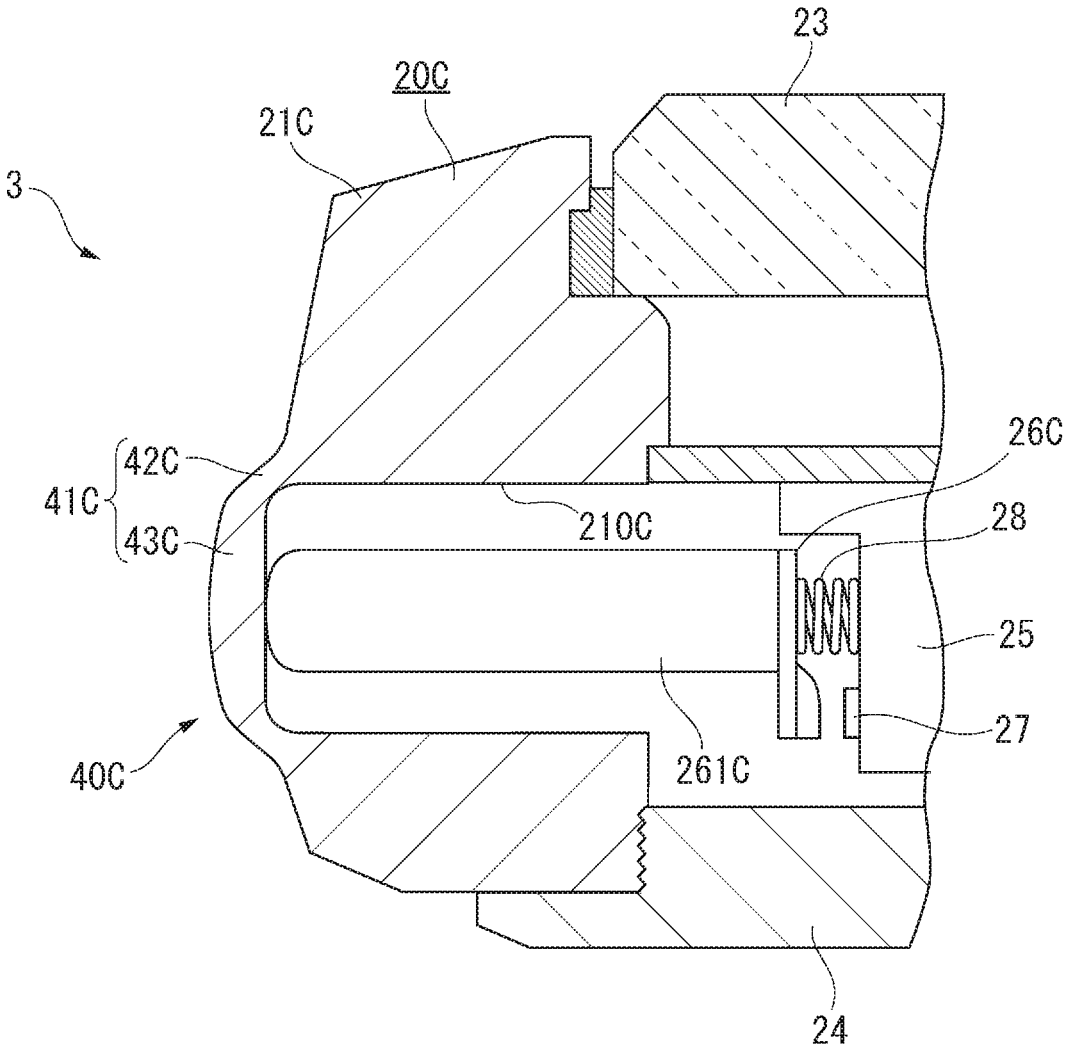
FIG. 5 is a section view illustrating main parts of the timepiece case in a third embodiment of the invention.

As shown in FIG. 5, the timepiece 3 has an operating button 40C with a button part 41C formed integrally to the case body 21C similarly to the operating button 40 of the first embodiment. Also as in the first embodiment, the button part 41C has a side part 42C contiguous to the case body 21C, and a substantially round top part 43C contiguous to the side part 42C.

Inside the case body 21C is formed a recess 210C that recedes from the inside circumference surface of the case body 21C similarly to the recess 210 in the first embodiment.

A button shaft part 261C disposed in unison with a switch spring 26C in the movement 25 is disposed in the recess 210C. In this embodiment, the button shaft part 261C extends from the switch spring 26C toward the outside of the case body 21C, that is, toward the button part 41C. The button shaft part 261C is urged by the coil spring 28 through the switch spring 26C, and is normally in contact with the top part 43C of the button part 41C.

When the user of the timepiece 1 pushes the button part 41C of the case member 20C, the top part 43C and the button shaft part 261C move to the inside of the case body 21C. As a result, the switch spring 26C disposed in unison with the button shaft part 261C also moves to the movement 25 side, contacts the detection electrode 27 disposed to the movement 25, and the control device of the timepiece 3 can detect that the button part 41C was pushed.

When the user of the timepiece 3 stops pushing the button part 41C, the switch spring 26C and button shaft part 261C are urged by the coil spring 28 and move toward the outside of the case member 20C. As a result, the switch spring 26C separates from the detection electrode 27, and the control device of the timepiece 3 can detect that the button part 41C was released and is not being pushed.

When the button shaft part 261C moves toward the outside of the case member 20C, the button shaft part 261C and the top part 43C of the button part 41C in contact with the button shaft part 261C also move toward the outside of the case member 20C, and the button part 41C returns to the original position protruding toward the outside of the case member 20C.

Effect of Embodiment 3

A flexible button part 41C is formed integrally to the case body 21C of the case member 20C. Because the button shaft part 261C disposed to the movement 25 is located in the recess 210C formed in the inside circumference side of the case body 21C, the same effects as in the first and second embodiments of the invention, including preventing water from penetrating through the recess 210C from the button part 41C, can be achieved.

In addition, because the button shaft part 261C is formed integrally with the switch spring 26C instead of using the button unit 50 of the first embodiment, the parts count can be reduced and the cost can be reduced.

Embodiment 4

A timepiece 4 according to a fourth embodiment of the invention is described next with reference to FIG. 6. Note that like configurations in the timepiece 4 according to the fourth embodiment of the invention and the timepiece 1 according to the first embodiment of the invention are identified by like reference numerals, and further description thereof is omitted.

A timepiece 4 according to the fourth embodiment of the invention has a case member 20D and a timepiece band not shown that attaches to the case member 20D. The timepiece band may be the same as the watch band 30 of the first embodiment, and further description thereof is omitted.

The case member 20D has a ring-shaped case body 21D. Like the case body 21 of the first embodiment, the case body 21D is made from metallic glass with an elastic modulus greater than or equal to 30 GPa and less than or equal to 140 GPa, and an elastic limit greater than or equal to 2% and less than or equal to 20%.

As in the first embodiment, a recess 210D recessed from the inside circumference surface is also formed in the case body 21D.

Figure 6:
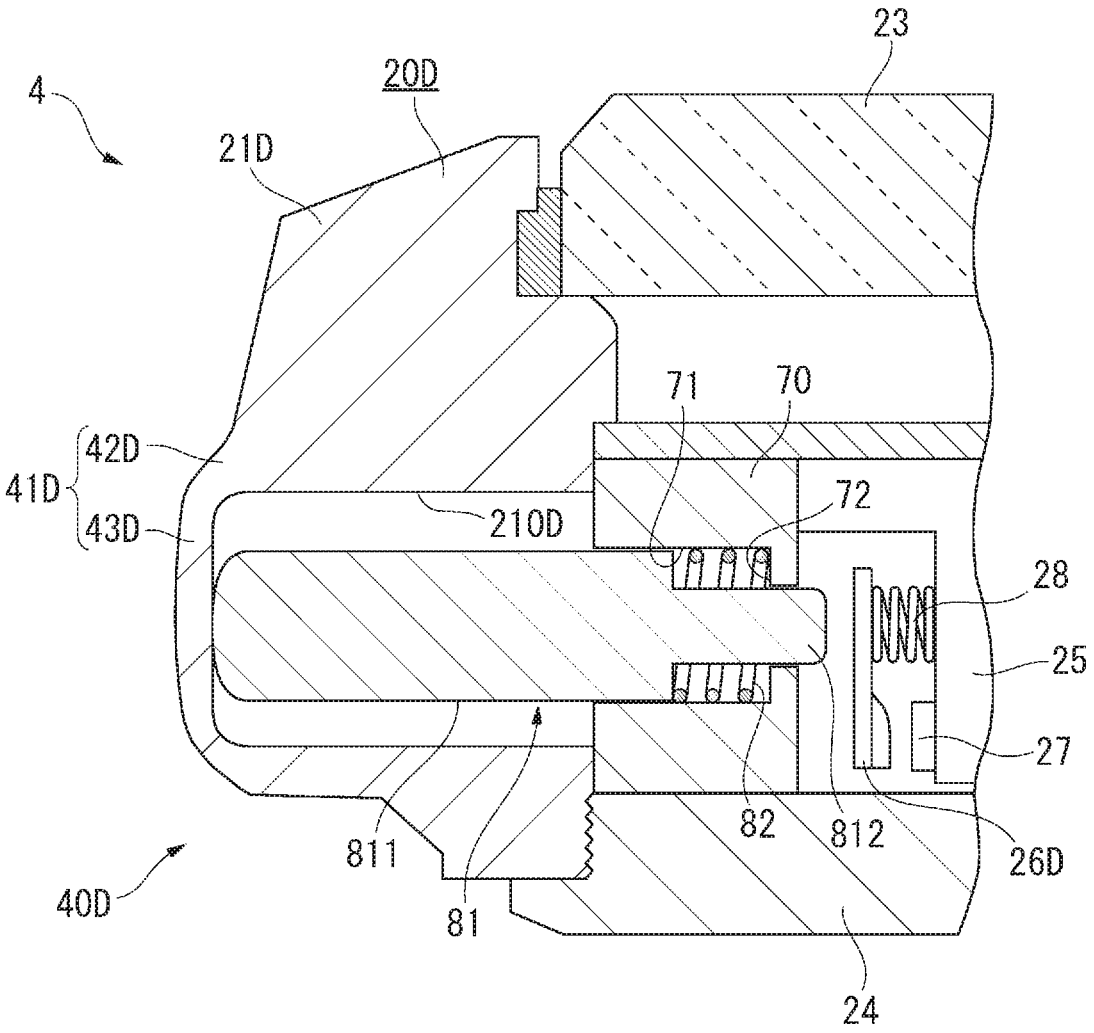
FIG. 6 is a section view illustrating main parts of the timepiece case in a fourth embodiment of the invention.

As shown in FIG. 6, the timepiece 4 has an operating button 40D with a button part 41D formed integrally to the case body 21D similarly to the operating button 40 of the first embodiment. Also as in the first embodiment, the button part 41D has a side part 42D contiguous to the case body 21D, and a substantially round top part 43D contiguous to the side part 42D.

A case ring 70 that secures the movement 25 in the case body 21D is also disposed between the case body 21D and the movement 25 in this embodiment. A communication hole 71 is formed in the case ring 70 between the case body 21D side and the movement 25 side, and a button shaft member 81 and return spring 82 are disposed in the communication hole 71.

Note that the button shaft member 81 is an example of a button shaft part in the accompanying claims.

The button shaft member 81 has a guide part 811 and a shaft part 812 that is smaller in diameter than the guide part 811, and is disposed movably in the axial direction inside the communication hole 71. Movement of the button guide part 811 is guided by the inside circumference side of the communication hole 71.

The guide part 811 of the button shaft member 81 is disposed inside the recess 210D. The button shaft member 81 can also move in the axial direction inside the recess 210D.

The return spring 82 is configured by a coil spring disposed in the communication hole 71 between the bottom part 72 of the case ring 70, and the guide part 811 of the button shaft member 81. The return spring 82 urges the button shaft member 81 in the direction of top part 43D of the button part 41D relative to the case ring 70. As a result, the button shaft member 81 is disposed in contact with the top part 43D of the button part 41D.

The shaft part 812 of the button shaft member 81 is disposed in opposition to the switch spring 26D of the movement 25. When the button part 41D is not depressed, the button shaft member 81 is urged by the return spring 82 to the button part 41D side, and a gap of a specific size is formed between the shaft part 812 and the switch spring 26D. The size of this gap is set smaller than the distance the button shaft member 81 can move when the button part 41D is pushed.

When the user of the timepiece 4 pushes the button part 41D of the case member 20D, force greater than the urging force of the return spring 82 is applied to the button shaft member 81 in contact with the top part 43, and the button shaft member 81 moves toward the switch spring 26D. When the button shaft member 81 moves a distance equal to or greater than this gap, the shaft part 812 contacts the switch spring 26D. As a result, the switch spring 26D also moves to the inside of the movement 25, and contacts the detection electrode 27 disposed in the movement 25, and the control device of the timepiece 4 can detect that the button part 41D was pushed.

When the user of the timepiece 4 stops pushing the button part 41D, the button shaft member 81 moves in the direction away from the switch spring 26D due to the urging force of the return spring 82. As a result, the switch spring 26D separates from the detection electrode 27, and the control device of the timepiece 4 can detect that the button part 41D was released and is not being pushed.

The return spring 82 also moves the top part 43D of the button part 41D toward the outside of the case member 20D through the intervening button shaft member 81, and the button part 41D returns to the original position protruding from the case member 20D.

Effect of Embodiment 4

A flexible button part 41D is formed in unison with the case body 21D of the case member 20D. A button shaft member 81 is also disposed in a recess 210D formed receding from the inside circumference side of the case body 21D. As a result, the same effects as in the first to third embodiments of the invention, including preventing water from penetrating through the recess 210D from the button part 41D, can be achieved.

Furthermore, because the button shaft member 81 is guided by the communication hole 71 of the case ring 70, the user can, by pushing the button part 41D, reliably cause the switch spring 26D to contact the detection electrode 27.

Embodiment 5

A timepiece 5 according to a fifth embodiment of the invention is described next with reference to FIG. 7. Note that like configurations in the timepiece 5 according to the fifth embodiment of the invention and the timepiece 1 according to the first embodiment of the invention are identified by like reference numerals, and further description thereof is omitted.

This timepiece 5 also has a case member 20E and a timepiece band not shown that attaches to the case member 20E. The timepiece band may be the same as the watch band 30 of the first embodiment, and further description thereof is omitted.

The case member 20E has a ring-shaped case body 21E. Like the case body 21 of the first embodiment, the case body 21E is made from metallic glass with an elastic modulus greater than or equal to 30 GPa and less than or equal to 140 GPa, and an elastic limit greater than or equal to 2% and less than or equal to 20%.

Figure 7:
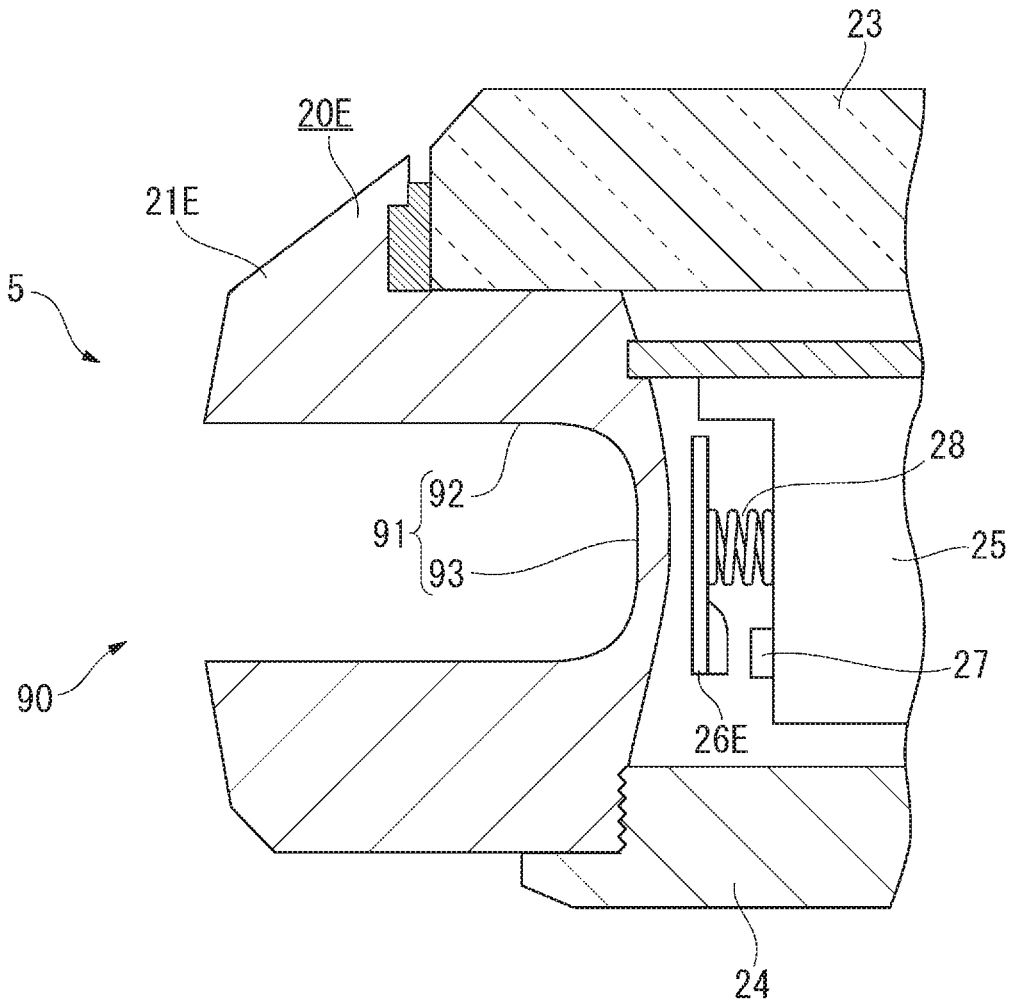
FIG. 7 is a section view illustrating main parts of the timepiece case in a fifth embodiment of the invention.

As shown in FIG. 7, the timepiece 5 according to this embodiment has an operating button 90.

This operating button 90 has a flexible button part 91 that is formed in unison with the case body 21E in the shape of a recess from the outside circumference side of the case body 21E.

The button part 91 has a side part 92 contiguous to the case body 21E, and a bottom part 93 formed contiguously to the side part 92 and in opposition to a switch spring 26E.

When the button part 91 is not depressed, there is a gap of a specific size between the bottom part 93 and the switch spring 26E. The size of this gap is set smaller than the distance the bottom part 93 can travel when the button part 91 is pushed.

When the user of the timepiece 5 pushes the button part 91 with the tip of a pen or other type of stylus member, the bottom part 93 moves toward the switch spring 26E. When the bottom part 93 moves a distance equal to or greater than the gap, the bottom part 93 contacts the switch spring 26E. As a result, the switch spring 26E also moves to the inside of the movement 25, contacts the detection electrode 27 disposed in the movement 25, and the control device of the timepiece 5 can detect that the button part 91 was pushed.

When the user of the timepiece 5 stops pushing the button part 91, the bottom part 93 returns to the original position. As a result, the switch spring 26E separates from the detection electrode 27, and the control device of the timepiece 5 can detect that the button part 91 was released and is not being pushed.

Effect of Embodiment 5

The timepiece 5 has a button part 91 that is flexible and is formed in unison with and in a shape recessed from the outside circumference side of the case body 21E.

As a result, the operating button 90 cannot be easily operated by a finger, must therefore be operated using the tip of a pen or other stylus-like member, and is therefore particularly effective for providing a button, such as a reset button, that is preferably difficult to operate.

Embodiment 6

A timepiece 6 according to a sixth embodiment of the invention is described next with reference to FIG. 8. Note that like configurations in the timepiece 6 according to the sixth embodiment of the invention and the timepiece 1 according to the first embodiment of the invention are identified by like reference numerals, and further description thereof is omitted.

A timepiece 6 according to the sixth embodiment of the invention has a case member 20F and a timepiece band not shown that attaches to the case member 20F. The timepiece band may be the same as the watch band 30 of the first embodiment, and further description thereof is omitted.

The case member 20F has a ring-shaped case body 21F. Like the case body 21 of the first embodiment, the case body 21F is made from metallic glass with an elastic modulus greater than or equal to 30 GPa and less than or equal to 140 GPa, and an elastic limit greater than or equal to 2% and less than or equal to 20%.

As in the first embodiment, a recess 210F recessed from the inside circumference surface is also formed in the case body 21F.

Figure 8:
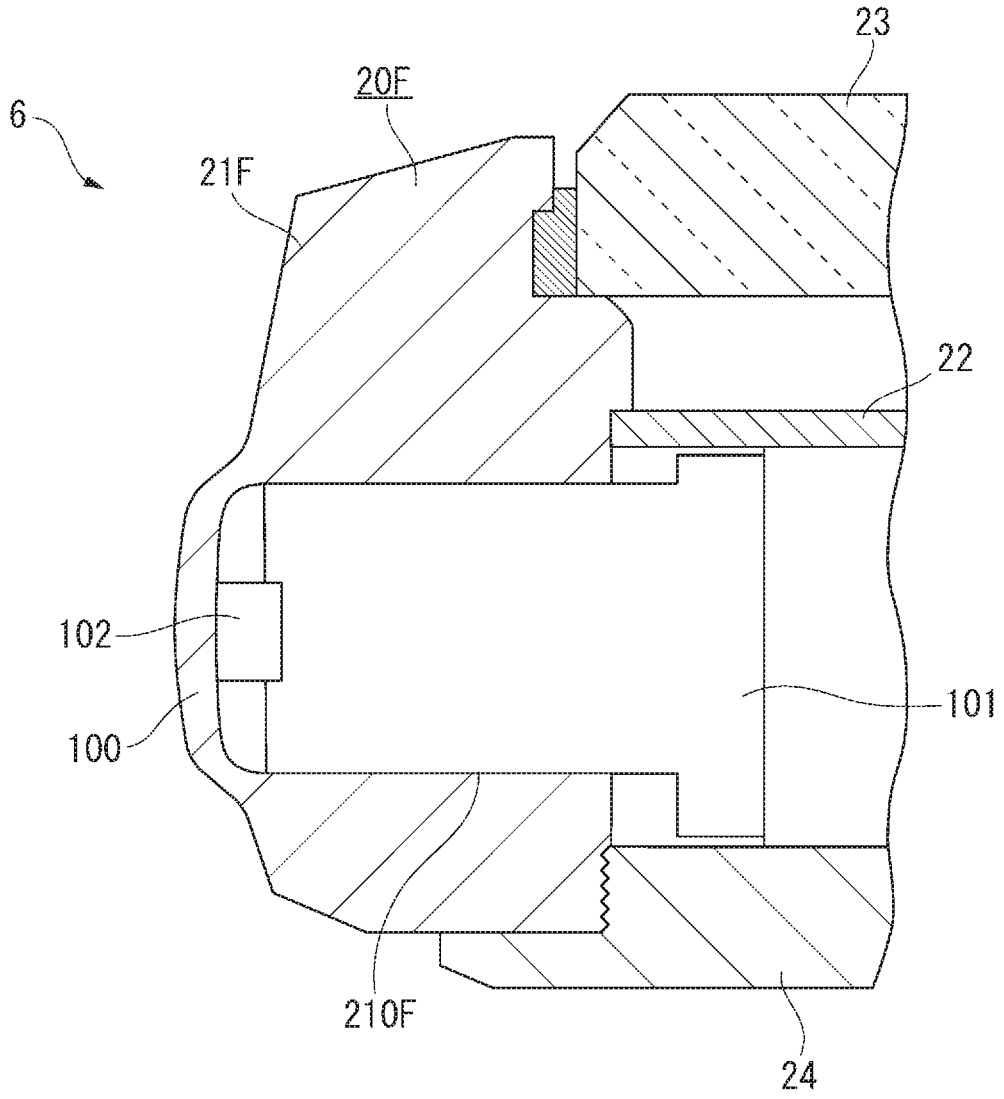
FIG. 8 is a section view illustrating main parts of the timepiece case in a sixth embodiment of the invention.

As shown in FIG. 8, the timepiece 6 has a diaphragm 100 formed integrally to the case body 21F. The diaphragm 100 is formed as a thin film with a thickness less than the case body 21F. As a result, the diaphragm 100 is configured to deform elastically according to the air pressure, or more simply pressure.

An air pressure sensor 101 is disposed in the recess 210F. The detector 102 of the air pressure sensor 101 contacts the diaphragm 100. As a result, the detector 102 is configured to detect air pressure, or simply pressure, on the diaphragm 100.

Effect of Embodiment 6

The timepiece 6 has a diaphragm 100 that is formed in unison with the case body 21F and deforms according to pressure. The timepiece 6 also has an air pressure sensor 101 with a detector 102 that detects pressure on the diaphragm 100.

As a result, water can be prevented from entering a timepiece 6 comprising the air pressure sensor 101 from space between the air pressure sensor 101 and case body 21F.

Other Embodiments

The invention is not limited to the embodiments described above, and can be modified and improved in many ways without departing from the scope of the accompanying claims.

Figure 9:
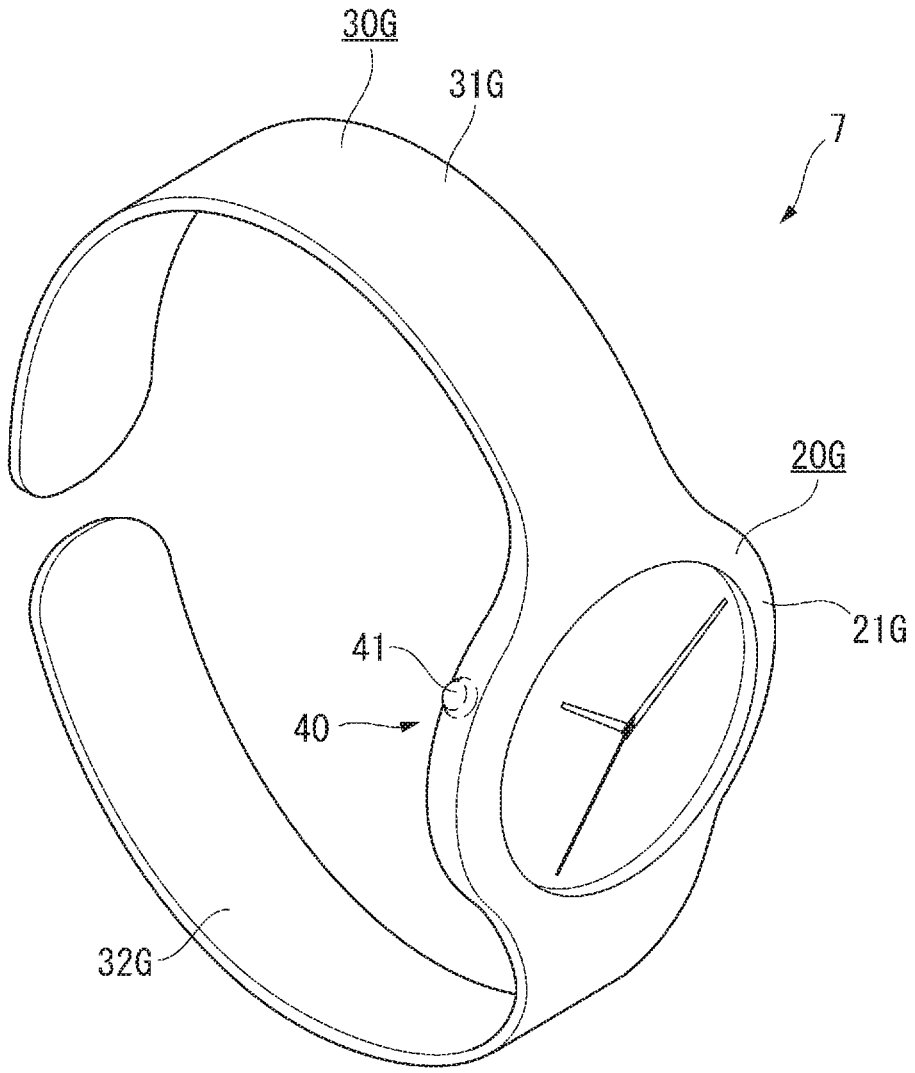
FIG. 9 is an perspective view of a timepiece according to another embodiment of the invention.

In the embodiments described above, the watch band 30 is formed separated from the case member 20, 20B, 20C, 20D, 20E, 20F, but as shown in the timepiece 7 in FIG. 9, the case member 20G and watch band 30G may be integrally formed.

The case member 20G has a ring-shaped case body 21G, and the watch band 30G includes a first band 31G and a second band 32G.

The case body 21G, first band 31G and second band 32G are integrally formed from metallic glass. Note that when the case body 21G, first band 31G and second band 32G are integrally formed, they are preferably configured by metallic glass having an elastic modulus greater than or equal to 30 GPa and less than or equal to 70 GPa. If the elastic modulus exceeds 70 GPa, elastic deformation of the watch band 30G becomes difficult, and the fit and feel when the watch band 30G is worn on the wrist are poor.

The timepiece 7 also has an operating button 40 configured the same as in the first embodiment. As a result, the same operational effect as the first embodiment can be achieved. In addition, because not only the case body 21G and operating button 40, but also the watch band 30G, are an integrated molding of metallic glass, the strength and aesthetic design of the timepiece 7 can be improved.

Figure 3:
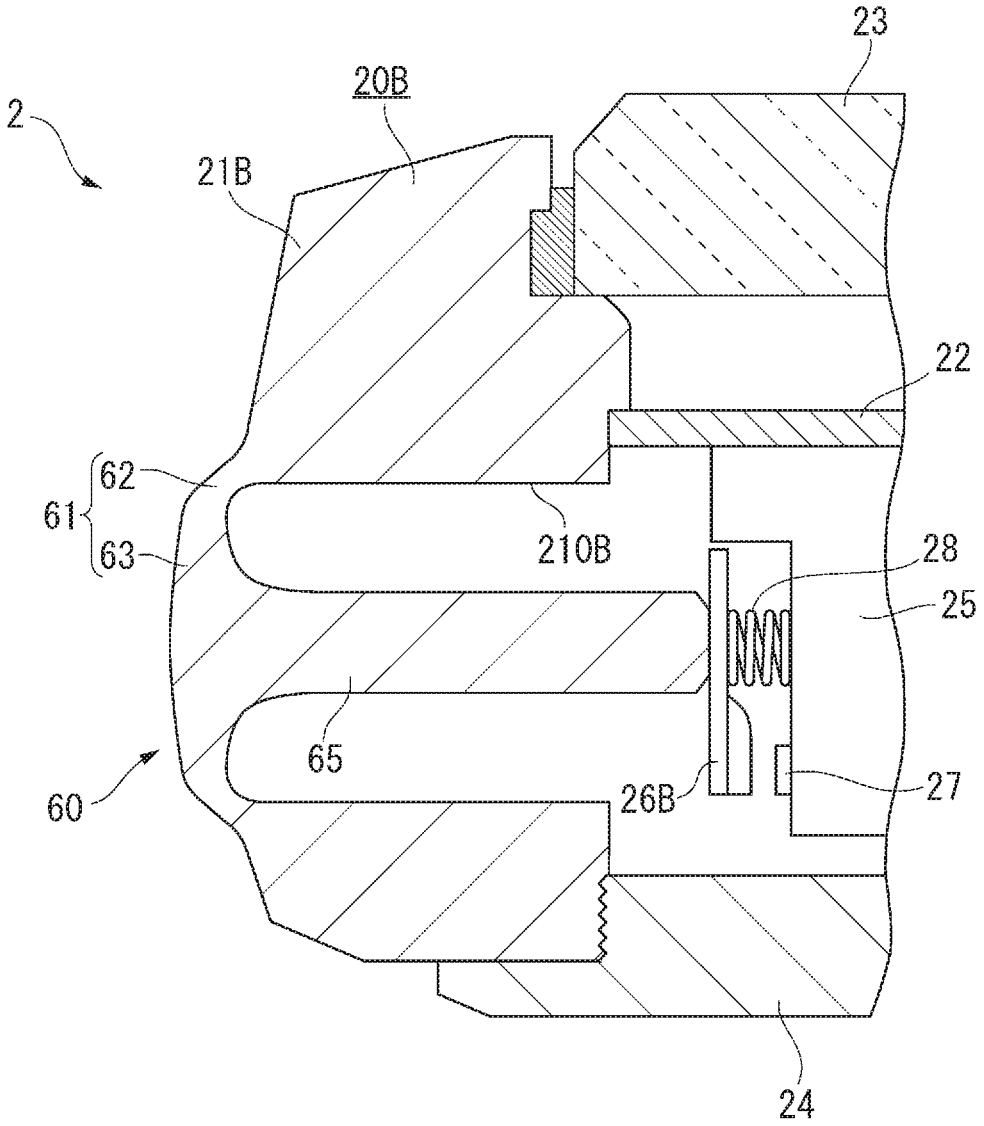
FIG. 3 is a section view illustrating main parts of the timepiece case in a second embodiment of the invention.

Note that the timepiece 7 may use an operating button 60 as shown in FIG. 3 and FIG. 4 instead of operating button 40. The timepiece 7 may also use the operating button 40C shown in FIG. 5, the operating button 40D shown in FIG. 6, or the operating button 90 shown in FIG. 7.

Yet further, the diaphragm 100 and air pressure sensor 101 shown in FIG. 8 may be used in the timepiece 7.

The operating buttons 40, 40C, 40D, 60, 90 formed integrally with the case bodies 21, 21B, 21C, 21D, 21E are also not limited to side buttons disposed in the side of the case body 21, 21B, 21C, 21D, 21E, and may be configured as front buttons disposed to the face side of the case body 21, 21B, 21C, 21D, 21E.

The configuration of the button unit 50 provided inside the recess 210 is also not limited to the configuration described in the first embodiment. For example, the button unit 50 may be configured with only a button shaft member 52 that is inserted movably in the axial direction in the recess 210 without having a guide pipe 51 and return spring 53. In this case, as in the second embodiment, a coil spring 28 causing the switch spring 26 to contact the button shaft member 52 is also provided, and the button shaft member 52 is urged by the switch spring 26 to the button part 41 side.

The return spring 82 also does not need to be disposed in the communication hole 71 in the timepiece 4 according to the fourth embodiment of the invention. In this case, the switch spring 26D may be disposed in contact with the button shaft member 81, and the button shaft member 81 urged to the button part 41D side by the urging force of the coil spring 28.

Because of their improved water resistance, timepieces 1, 2, 3, 4, 5 using the operating buttons 40, 40C, 40D, 60, 90 described above are also particularly well suited to diver watches and other timepieces requiring water resistance. A one-piece timepiece case comprising a case member 20, 20B, 20C, 20D, 20E and a back cover 24 integrally formed from metallic glass may also be used to improve water resistance. By using a one-piece timepiece case, water resistance can be further improved, a shoulder at the connection between the case body and the back cover can be eliminated, and the fit and feel when worn on the wrist can be improved.

To further improve water resistance, a timepiece without a crown can also be configured. Because a crown passes through the timepiece case, the crown affects the overall water resistance of the timepiece. Therefore, by eliminating the crown and providing only an operating button 40, 40C, 40D, 60, 90, the overall water resistance of the timepiece can be improved.

Note that the hand positions are typically adjusted using a crown in a common timepiece, but in an electronic timepiece using a quartz movement, motors can be operated using only button operations to adjust the positions of the hands, and a timepiece without a crown can be easily achieved.

In the timepieces 1, 2, 3, 4, 5, 6, 7 described above, the dial 22 may be formed integrally to the case body 21, 21B, 21C, 21D, 21E, 21F, 21G. If the dial 22 is formed integrally to the case body 21, 21B, 21C, 21D, 21E, 21F, 21G, the rigidity of the case body 21, 21B, 21C, 21D, 21E, 21F, 21G can be improved. In addition, time markers, logos, scales and other elements of the dial can be formed integrally to the dial 22, and the design and appearance can be improved.

The method of manufacturing the case member 20, 20B, 20C, 20D, 20E, 20F, 20G and timepiece band 30, 30G may be any manufacturing method suitable for metallic glass materials, and may be desirably adapted according to the structure of the manufactured product.

The watch band 30 that is separate from the case member 20, 20B, 20C, 20D, 20E, 20F, 20G is not limited to metallic glass configurations. For example, the watch band 30 may be metal band comprising multiple metal links, a leather band, or a plastic band.

A timepiece 1, 2, 3, 4, 5 using the operating buttons 40, 40C, 40D, 60, 90 described above may also have functions other than for displaying the time. For example, environmental sensors for measuring temperature, humidity, air pressure, UV exposure, and light may be provided to enable functions for displaying by analog hands or a digital display the results of measurements from the sensors.

Biological sensors for measuring the pulse rate, blood pressure, body temperature, or body movements of the user wearing the timepiece 1, 2, 3, 4, 5 may also be provided, and functions for displaying by analog hands or a digital display the results of measurements from the sensors may be provided.

The timepiece may also have functions for communicating with smartphones and other devices, and functions for displaying by analog hands or a digital display the communication state or communication content.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A timepiece case comprising:

a case body that is made of metallic glass; and a button part that is formed integrally with the case body as a one-piece unitary body and is flexible.

2. The timepiece case described in claim 1, wherein:

the metallic glass has an elastic modulus greater than or equal to 30 GPa and less than or equal to 140 GPa, and an elastic limit greater than or equal to 2% and less than or equal to 20%.

3. The timepiece case described in claim 1, wherein:

a recess is formed receding from the inside circumference surface of the case body; and a button shaft part that moves in conjunction with operation of the button part is disposed in the recess.

4. The timepiece case described in claim 2, wherein:

a recess is formed receding from the inside circumference surface of the case body; and a button shaft part that moves in conjunction with operation of the button part is disposed in the recess.

5. The timepiece case described in claim 3, further comprising:

a guide pipe disposed to the inside circumference side of the recess and guiding the button shaft part; and a return spring disposed between the guide pipe and the button shaft part, and urging the button shaft part to the button part side side relative to the guide pipe.

6. The timepiece case described in claim 4, further comprising:

a guide pipe disposed to the inside circumference side of the recess and guiding the button shaft part; and a return spring disposed between the guide pipe and the button shaft part, and urging the button shaft part to the button part side side relative to the guide pipe.

7. The timepiece case described in claim 1, wherein:

a recess is formed receding from the inside circumference surface of the case body; and the button part is formed in unison with the button shaft part disposed in the recess.

8. The timepiece case described in claim 2, wherein:

a recess is formed receding from the inside circumference surface of the case body; and the button part is formed in unison with the button shaft part disposed in the recess.

9. The timepiece case described in claim 7, wherein:

a guide member that guides the button shaft part is disposed in the case body.

10. The timepiece case described in claim 8, wherein:

a guide member that guides the button shaft part is disposed in the case body.

11. The timepiece case described in claim 1, wherein:

the button part is formed in a recessed shape from the outside circumference side of the case body.

12. The timepiece case described in claim 2, wherein:

the button part is formed in a recessed shape from the outside circumference side of the case body.

13. A timepiece comprising:

a timepiece case having a case body that is made of metallic glass, and a button part that is formed integrally with the case body as a one-piece unitary body and is flexible; and a movement which is held in the timepiece case, and of which an operating function is selected by operation of the button part.

14. The timepiece described in claim 13, wherein:

a recess is formed receding from the inside circumference surface of the case body;

a button shaft part that moves in conjunction with operation of the button part is disposed in the recess; and the button shaft part is disposed to the timepiece case or the movement.

15. The timepiece described in claim 13, further comprising:

a case ring holding the movement in the case body and disposed between the case body and the movement;

a communicating hole formed in the case ring between the case body side and the movement side, and a button shaft part that moves in conjunction with operation of the button part disposed in the communicating hole.

16. The timepiece described in claim 13, wherein:

the button part is formed in a recessed shape from the outside circumference side of the case body.

17. A timepiece comprising:

a timepiece case including a case body that is made of metallic glass, and a diaphragm formed integrally to the case body as a one-piece unitary body and deformed in response to applied pressure; and a detector configured to detect pressure acting on the diaphragm.

18. The timepiece case described in claim 1, wherein:

the button part has a top part and a side part that connects the top part with the case body, wherein the top part has a thickness thinner than the case body, and the side part has a thickness that is thinner than both the top part and the side part.

19. The timepiece case described in claim 3, wherein:

the button part and the button shaft part are separate pieces of structure.

* * * * *